US006852073B2

(12) United States Patent
Neumann et al.

(10) Patent No.: US 6,852,073 B2
(45) Date of Patent: Feb. 8, 2005

(54) FOLDER APPARATUS

(75) Inventors: Fred Neumann, Tamm (DE); Hatto Hechler, Stuttgart (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 394 days.

(21) Appl. No.: 09/855,929

(22) Filed: May 15, 2001

(65) Prior Publication Data

US 2001/0049326 A1 Dec. 6, 2001

(30) Foreign Application Priority Data

May 15, 2000 (DE) ..... 100 23 594

(51) Int. Cl.[7] ..... B31F 1/10
(52) U.S. Cl. ..... 493/435; 493/424; 493/434
(58) Field of Search ..... 493/400, 402, 493/403, 405, 424, 434, 454, 435, 442, 397, 399, 476

(56) References Cited

U.S. PATENT DOCUMENTS 4,995,600 A * 2/1991 Kovac et al. ..... 270/45
5,766,122 A * 6/1998 Hamilton ..... 493/420
5,980,444 A * 11/1999 Dickhoff ..... 493/433
5,989,174 A * 11/1999 Patrizio ..... 493/413
6,206,817 B1 * 3/2001 Sette et al. ..... 493/421

FOREIGN PATENT DOCUMENTS

| | | |
|---|---|---|
| DE | 1 436 596 | 3/1969 |
| DE | 3147064 A1 | 6/1983 |
| DE | 43 32 792 A1 | 3/1995 |
| EP | 0 153 668 A2 | 9/1985 |
| GB | 1080050 | 8/1967 |
| GB | 2 282 133 A | 3/1995 |

* cited by examiner

*Primary Examiner*—Eugene Kim
*Assistant Examiner*—Christopher Harmon
(74) *Attorney, Agent, or Firm*—Laurence A. Greenberg; Werner H. Stemer; Ralph E. Locher

(57) ABSTRACT

The side walls of a folder unit are embodied with opposed recesses. Additional processing elements, which enhance the variability of the folder unit, can be introduced into the recesses. It is especially advantageous in the recesses of the side walls of the folder unit to provide a processing element which is supported pivotably and has a delivery roller.

23 Claims, 7 Drawing Sheets

FOLDER APPARATUS

BACKGROUND OF THE INVENTION

FIELD OF THE INVENTION

The invention relates to a folder unit for a folding machine, which has a plurality of rollers, in particular folding rollers, and side walls on which the rollers are supported on both sides.

A folder unit of this kind has become known, for instance, from German published patent application DE 31 47 064. There, a plurality of folding rollers, with the aid of which an entering foldable product is folded, are disposed between two side walls. Furthermore, as is usual in folder units, a so-called delivery roller is disposed at the outlet of the folder unit; it carries the folded product out of the folder unit and delivers it to the next processing station. Upstream of the delivery roller is typically a pair of knife shafts, with the aid of which a blank can be made or the product to be folded can be perforated. In the prior art configuration, the pair of knife shafts is thus followed in the paper travel direction by a delivery roller, which along with the simple purpose of delivering the products to be folded can also be used to carry a scoring, cutting or perforating device.

Folding machines of that kind have the disadvantage that because of the fixed mounting of the delivery rollers in the housing walls, they cannot be altered and thus it is difficult, if not impossible, to adapt the folder unit to different customer requirements.

SUMMARY OF THE INVENTION

The object of the present invention is to provide a folder apparatus which overcomes the above-noted deficiencies and disadvantages of the prior art devices and methods of this general kind, and which enhances and improves the variability of a folder unit.

With the above and other objects in view there is provided, in accordance with the invention, a folder unit, comprising:

side walls;

a plurality of rollers, such as folding rollers and/or knife rollers, rotatably supported in the side walls;

each of the side walls having a recess formed therein opposite from one another and configured to receive therein a processing element to be connected to the folder unit.

The provision of recesses in the side walls of the folder unit, which are suited to receiving a processing element, has a number of advantages, because it thus becomes possible to provide individual processing stations at the outlet of the folder unit. Different inserts can be mounted in the recesses to suit various requirements.

In accordance with a preferred feature of the invention, the two recesses in the side walls are mounted opposite one another and have essentially the same shape. Between the recesses in the side walls, an insert is mounted that is pivotable in the paper travel direction. If the processing element is a delivery roller, then it can be hinged outward by simple pivoting in the paper travel direction. This facilitates access to the knife shafts behind it considerably, making it easy to modify how they are outfitted.

In accordance with a further preferred feature of the invention, the insert has a further pair of knife shafts. This so-called downstream-supported pair of knife shafts enhances the variability of the processing capability considerably. If a further delivery roller is to be disposed downstream of the second, downstream-supported pair of knife shafts, then it is especially advantageous for the insert itself to be provided in turn on both sides, that is, in the plane of both frame parts, with a recess which in turn makes it possible afterward to mount an additional processing element. By using inserts with recesses, it is accordingly possible to design the folder unit in modular fashion and to meet increasingly varied customer requirements.

In accordance with an added feature of the invention, the processing element includes a roller, such as a delivery roller and/or a knife shaft. Also, the processing element may further include a delivery roller disposed downstream of the knife shaft in a product travel direction defined through the folder unit.

In accordance with an additional feature of the invention, as mentioned above, the processing element is pivotably mounted in the recesses in a product travel direction defined through the folder unit. Preferably, the processing element is mounted to be locked in a plurality of pivoting positions.

In the multiple-unit embodiment, the above-mentioned processing element is a first processing element and the first processing element includes two processing element side walls each formed with a recess. The recesses in the processing element side walls are located opposite one another and are configured to receive therein a further processing element. The further processing element can be rigidly connected to the first processing element. In that embodiment, the further processing element may be pivotally mounted in the first processing element.

In accordance with a further feature of the invention, the processing element includes a cross-member pivotally mounted above the delivery roller, and configured for receiving additional elements. The additional elements may be conventional elements such as a stripper a light scanner.

In the non-pivoted position, the processing element is rigidly connected to the side walls. For that purpose, there may be provided a corresponding bracket, a bolt, or the like, i.e., an additional coupling device for rigidly connecting the processing element to at least one of the side walls in a non-pivoted position of the processing element.

In accordance with another feature of the invention, the rollers include at least two folding rollers driven through a gear plate, and the processing element is supported outside the gear plate.

In accordance with again another feature of the invention, the folding rollers are driven by a drive, and the processing element is coupled to the drive of the folding rollers. Preferably, they are mechanically coupled to the drive of the folding rollers. Possible couplings are a belt drive, a pulley drive, or a chain drive. In the alternative, or in addition, there may be provided a control device for coupling the drive and the processing element.

In accordance with a concomitant feature of the invention, the rollers of the processing element have a gear wheel, and wherein at least one further gear wheel of the folder unit meshes with the gear wheel of the roller of the processing element.

Other features which are considered as characteristic for the invention are set forth in the appended claims.

Although the invention is illustrated and described herein as embodied in a folder apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
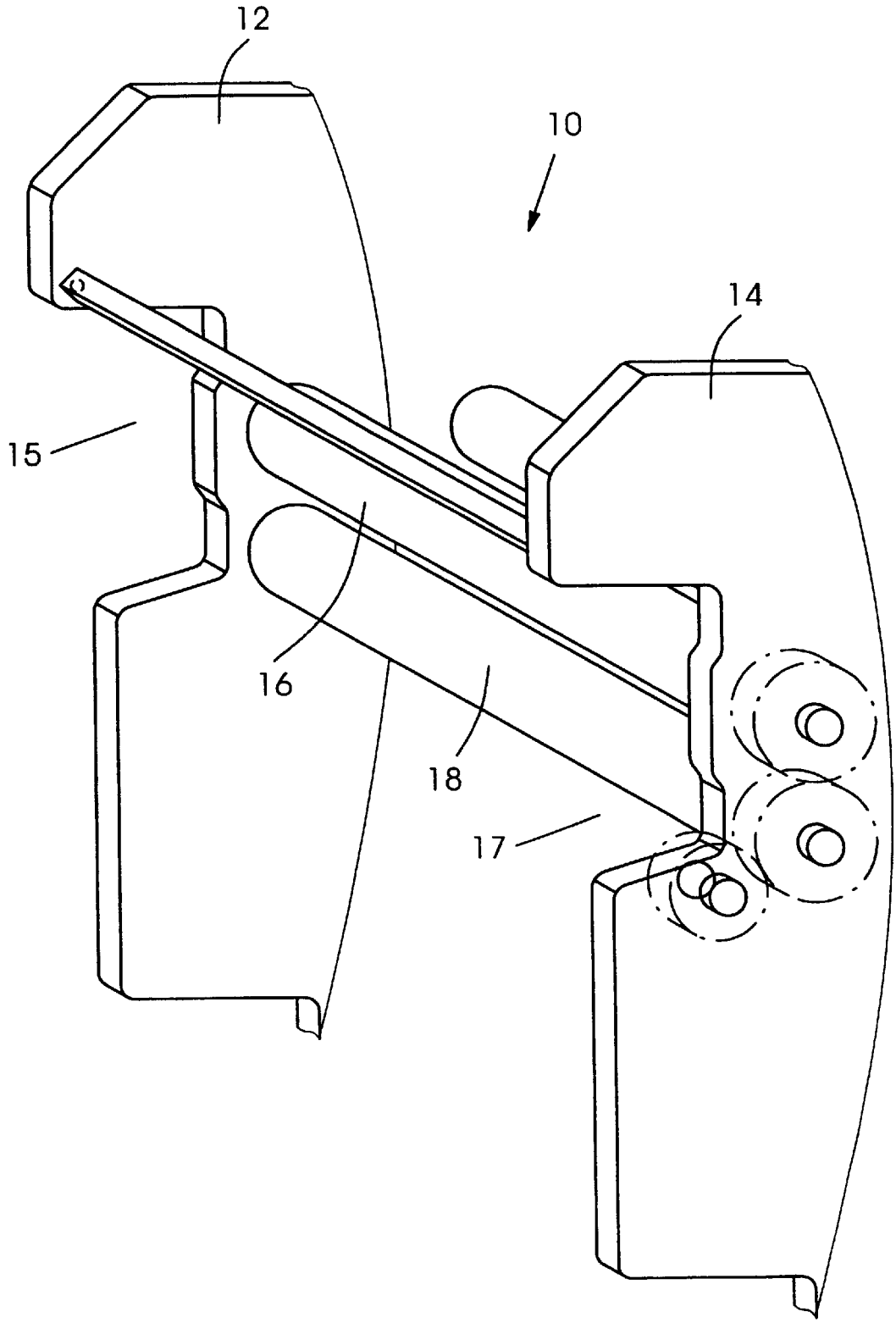
FIG. 1 is a diagrammatic perspective view of the frame part of the folder unit according to the invention.

Referring now to the figures of the drawing in detail and first, particularly, to FIG. 1 thereof, there is seen a detail of a folder unit 10 according to the invention. The folder unit 10 has two opposed side walls 12 and 14, on which a plurality of rollers is rotatably supported. Of the rollers, knife shafts 16 and 18 are shown. The two side walls 12 and 14 are each formed with a respective recess 15, 17, so that one processing element can be inserted fittingly on both sides into the applicable recess. Although the shape of the recesses 15 and 17 can be variable, it is advantageous if the shape of the opposed recesses is the same.

Figure 2:
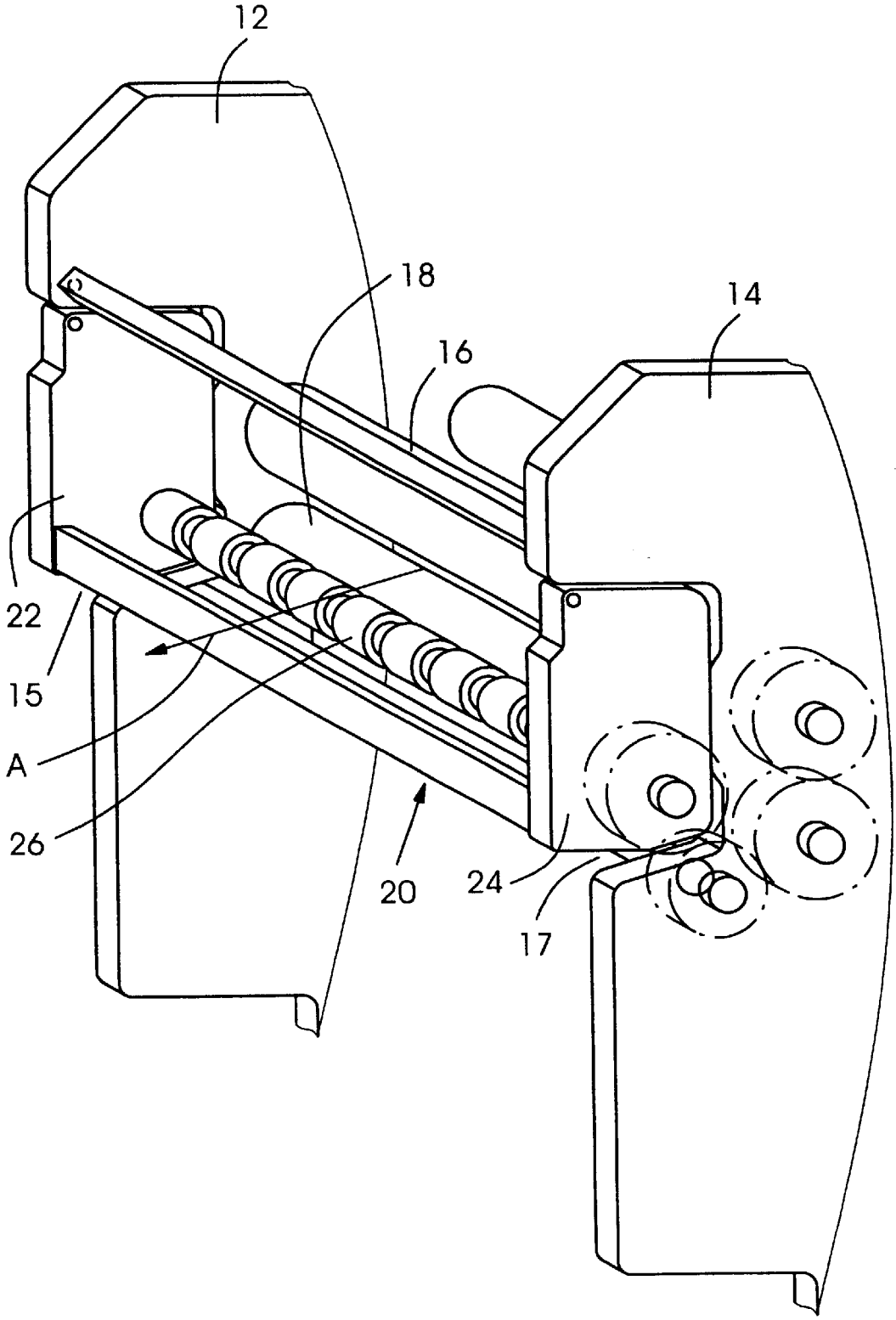
FIG. 2 is a diagrammatic perspective view of the folder unit of the invention with a pivotable insert.

In FIG. 2, the folder unit of the invention is shown schematically in perspective, with an inserted processing element 20. The processing element 20 has two side walls 22 and 24, which are inserted into the recesses 15 and 17 of the side parts 12 and 14. In the present example, the processing station has a so-called delivery roller 26, which removes the paper in the paper travel direction A and optionally delivers it to a further processing station. As already shown in FIG. 1, further rollers, in particular the knife shafts 16 and 18, are located behind the delivery roller 26, or in other words upstream in the paper travel direction; with these knife shafts, it is necessary to monitor their outfitting at regular intervals and sometimes to change it. According to the invention, it is therefore especially advantageous to secure the processing element 20 to the frame parts 12 and 14 of the folder unit in such a way that the frame parts can be folded out of the way by a simple pivoting motion, so that after they have been pivoted out of the way, access to the knife shafts 16 and 18 is made possible.

Figure 3:
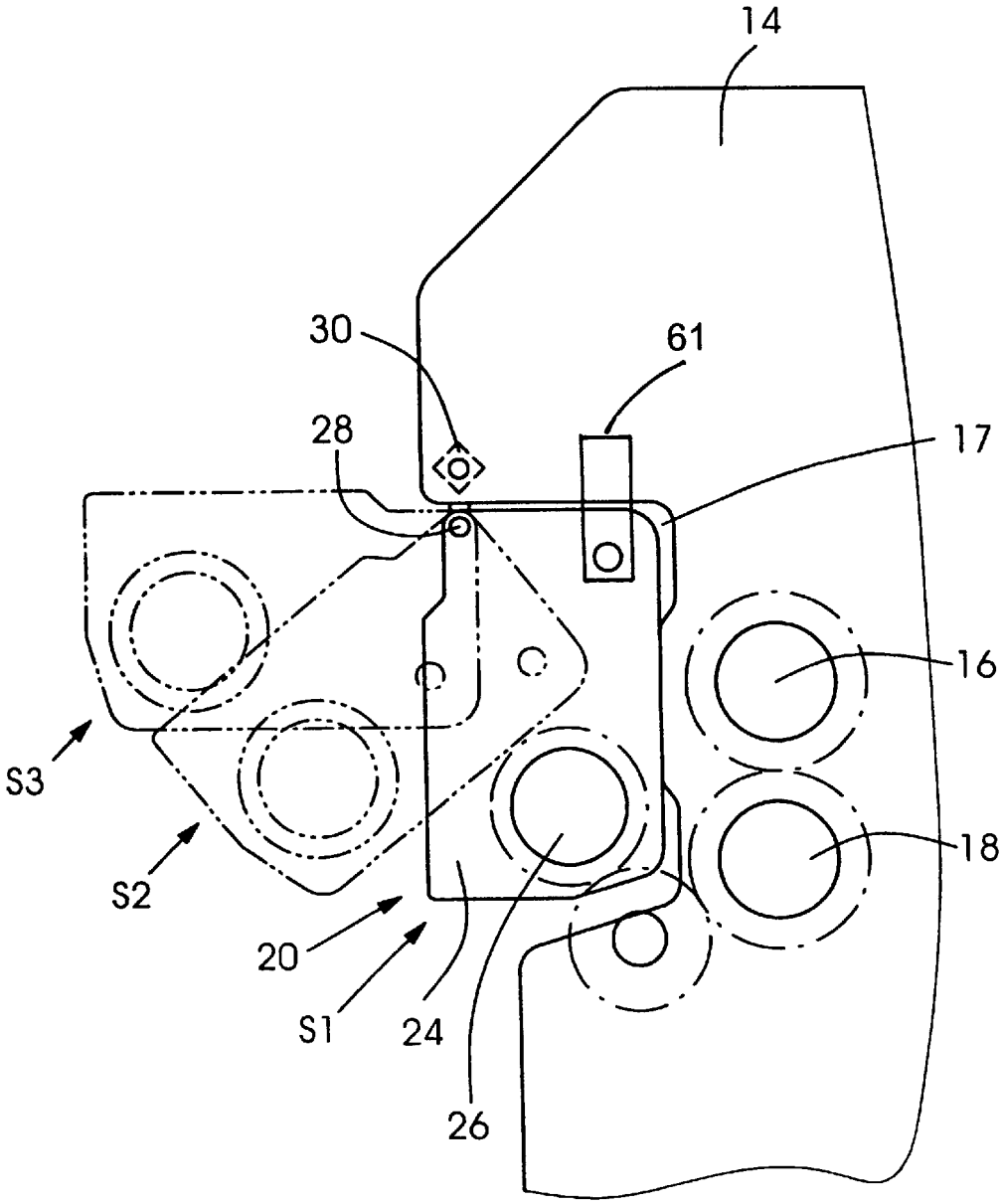
FIG. 3 is a side view of the unit with a pivotable insert.

In the schematic side view of FIG. 3, the side wall 14 of a folder unit 10 of the invention is shown. In the side wall 14, the recess 17 is provided, in which the processing element 20 is placed so as to be pivotable about a pin shaft 28. The processing element 20 has a side wall 24, which is shaped such that there is space for it in the recess 17. A delivery roller 26 is also provided in the processing element 20. Three exemplary pivoting positions S1, S2 and S3 of the processing element 20 are shown. The pivoting position S1 represents the processing station 20 introduced all the way into the folder unit. In this position, the processing station can also be connected solidly to the roller unit. Particularly to enable access to the pair of knife shafts 16, 18, the processing station 20 can be pivoted about the shaft 28 in the paper travel direction, for instance into the two positions S2 and S3. A grid module can be provided, which keeps the processing element 20 at defined grid spacings between the pivoting positions S1 and S3. The element 20 can also be pivoted with the aid of a gridless mechanism, which in particular allows it to be locked in the pivoting positions S1 and S3. As soon as the processing element 20 has been pivoted outward into the grid position S3, access to the pair of knife shafts 16 and 18 is available.

The folder unit of the invention offers the particular advantage that the outfitting of the knife shafts can easily be changed, and easier access for other tasks is also possible. After the setting tasks have been effected at the pair of knife shafts 16 and 18, the locking of the processing element 20 is unlatched again, and the processing element is pivoted back from the position S3 into the position S1 again. The processing element is locked in this position and in particular screwed down, and the drive of the delivery roller 26 is re-activated. This can for instance be done by providing the delivery roller 26 with a lateral gear wheel, which is positioned in its engagements.

In addition to the pivotable processing element, the folder unit of the invention can also have a cross-member 30. Typically, additional elements such as strippers and light scanners are mounted on this cross-member 30. The diagrammatic illustration at 30, therefore, should be understood to include such conventional additional elements such as strippers, light scanners, or the like. Advantageously, the cross-member 30 located above the processing element 20 is also equipped to be pivotable, so that upon the pivoting of the cross-member 30, the setting tasks at the knife shafts and at the cross-member itself can also be made easier.

Figure 4:
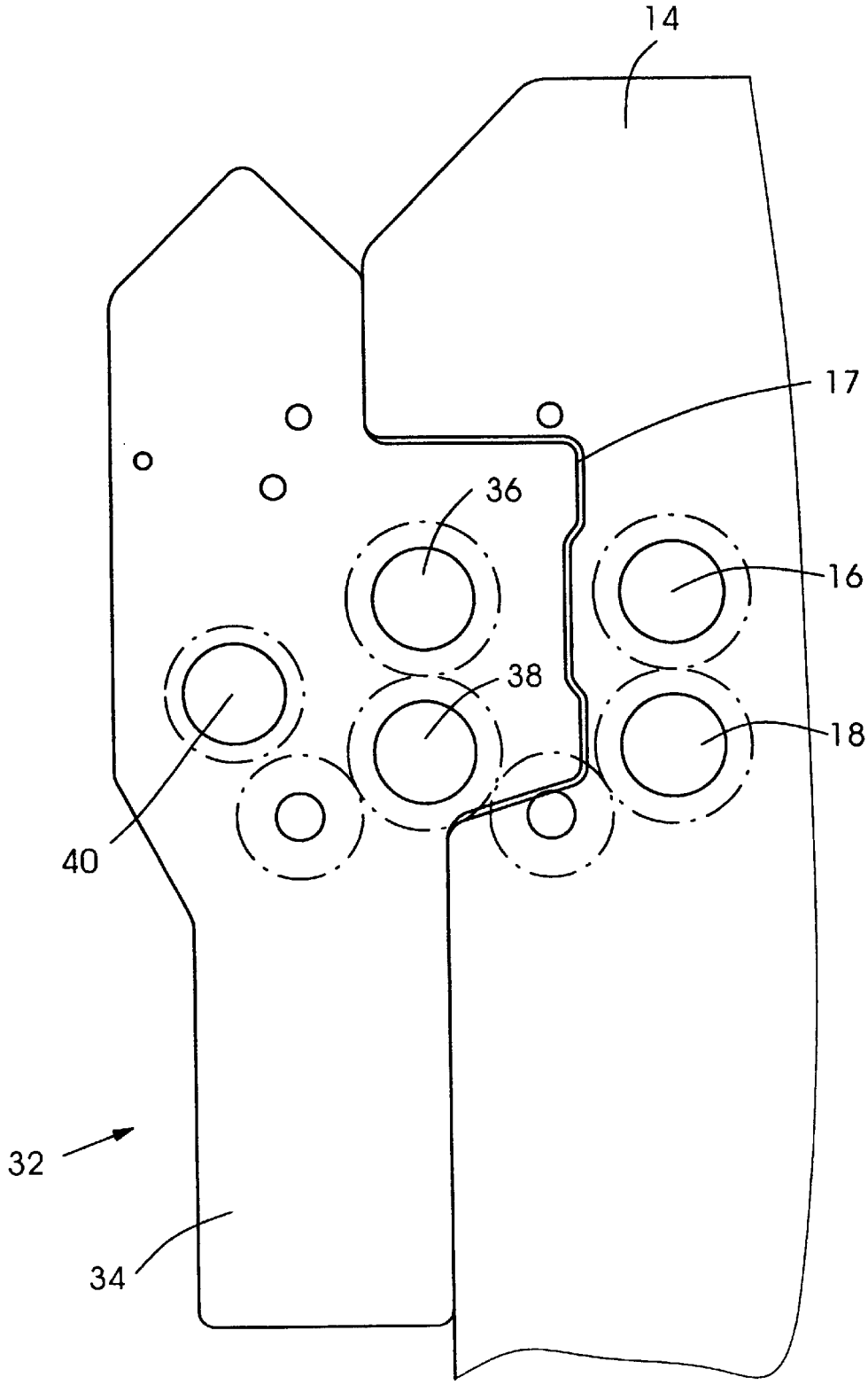
FIG. 4 is a side view of the unit with a downstream-supported double knife shaft.

In a further exemplary embodiment, the folder unit of the invention is shown in a side view in FIG. 4. A pair of knife shafts 16 and 18 is rotatably supported in the side wall 14 of the folder unit, and a recess 17 is provided, into which a processing element 32 is inserted. The element 32 has a side wall 34 and a pair of knife shafts 36, 38. Also provided in the processing station 32 is a delivery roller 40, which serves to deliver the sheet of paper emerging from the folder unit. The side wall 34 of the processing element 32 is shaped such that it can be introduced into the recess 17 in the side wall of the folder unit and locked there. To that end, it can in particular have a protrusion that engages the recess 17. With a processing element 32 designed in this way, the variability of the folder unit can be increased markedly, since the downstream-supported pair of knife shafts 36 and 38 can receive additional processing elements, with which additional grooves, scoring or perforation can be made. Furthermore, in this configuration there is the advantage that the processing element 32 can be mounted as needed, and even retrofitted, on the folder unit. To make it possible to set the spacing between the knife shafts of the second downstream-supported pair of knife shafts 36, 38, an additional roller gap setting device to be installed retroactively is provided.

Figure 5:
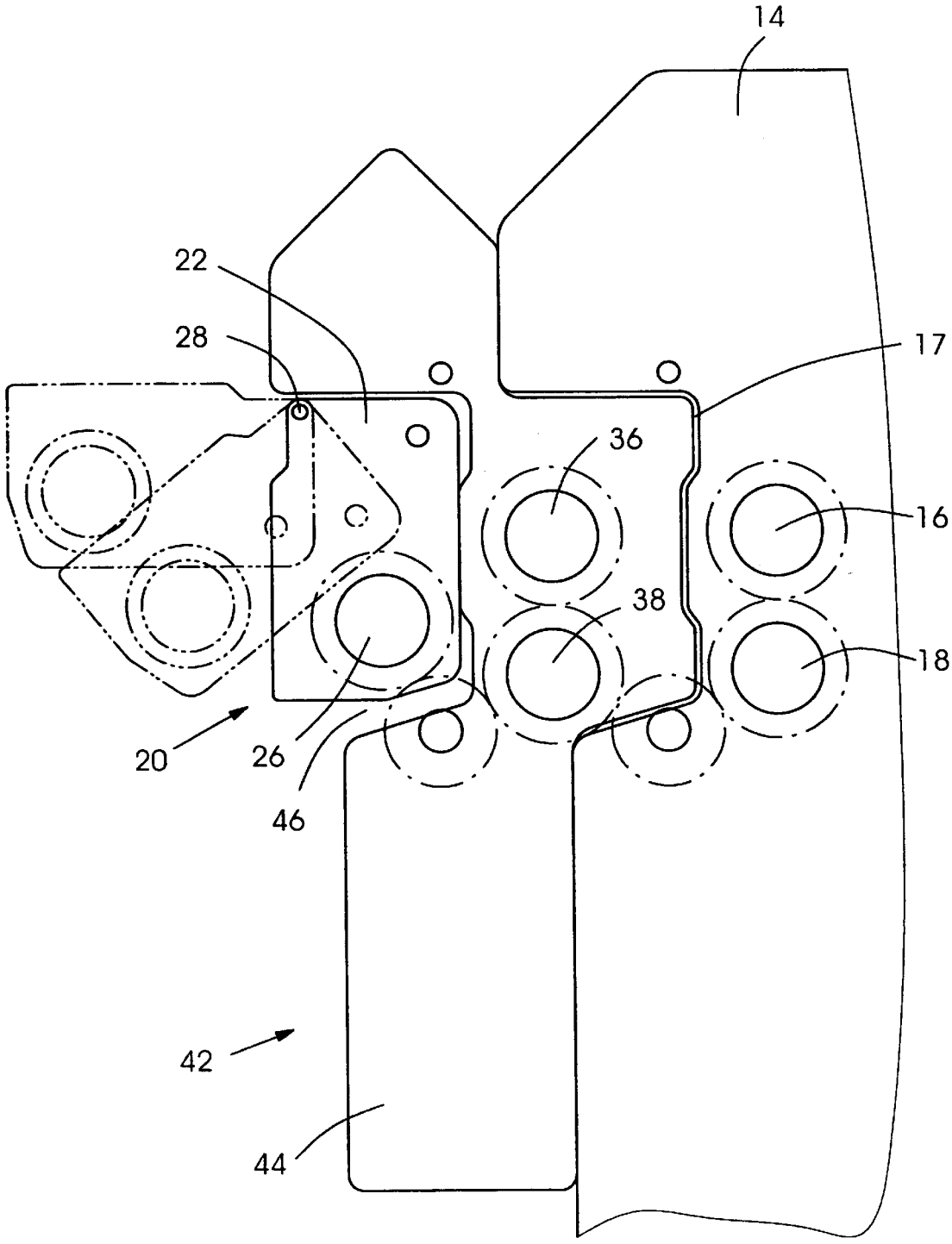
FIG. 5 is a side view of the unit with a first insert with a downstream-supported double knife shaft and with a second pivotable insert with a delivery roller.

A further exemplary embodiment, or variation, of the folder unit according to the invention is shown in side view in FIG. 5. One side wall 14 of the folder unit has a recess 17, in which a processing element 42 is placed whose side wall 44 is shaped such that it can be introduced into the recess 17 and locked there. The processing element 42 has two downstream-supported knife shafts 36 and 38, which as already described in the above examples markedly increase the variability of the folder unit. In the side wall of the processing element 42, a recess 46 is also provided, in which a further processing element 20 can also be placed, preferably pivotably. This kind of modular folder unit of the invention can be adapted optimally to given requirements, since it is possible in principle to provide an arbitrary number of processing stations 42 in succession, each of which carries a downstream-supported pair of knife shafts 36, 38. At the outlet of the folder unit, a processing element 20 rotatably supported about the pivot shaft 28 and having a delivery roller 26 is preferably introduced into the recess 46 of the last processing element 42.

Figure 6:
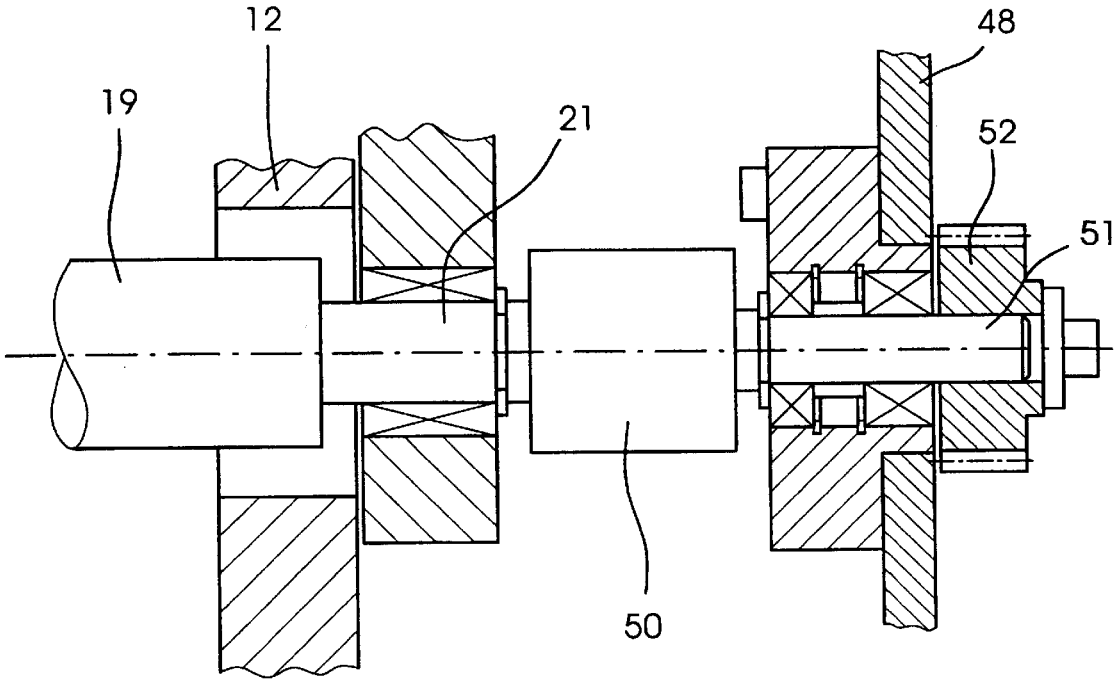
FIG. 6 is a partial cross-section with a gear plate.

To optimize the drive of a folder unit, it is already known, as shown in FIG. 6, to provide a gear plate 48. To that end, the shaft 21 of the folding roller 19 is connected via a coupling 50 to a drive shaft 51, which in turn is connected in stationary fashion, via a bearing, to the gear plate 48 and is guided through the gear plate 48. The folding roller 19 can be driven via the gear wheel 52 located on the outside.

Figure 7:
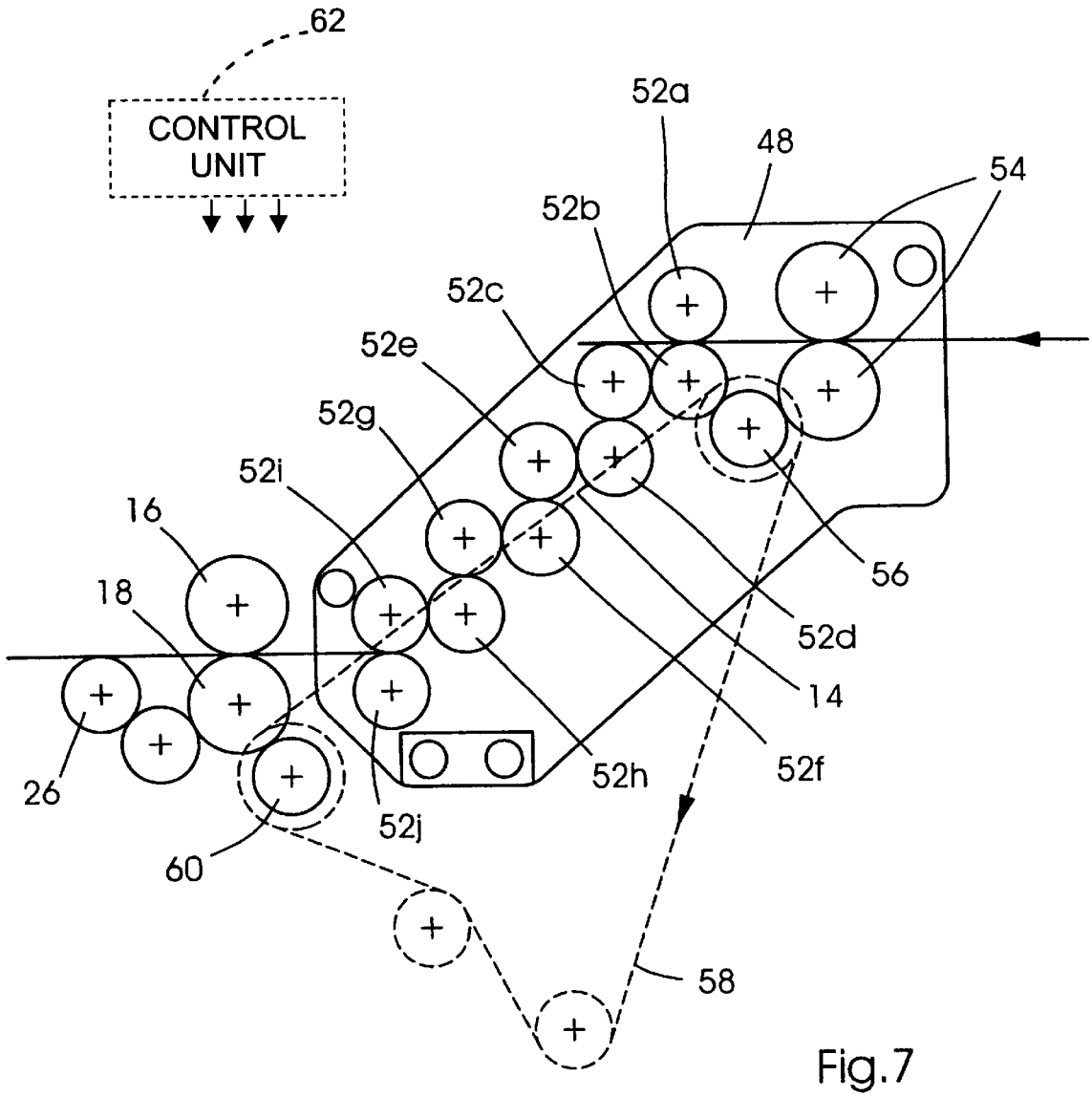
FIG. 7 is a schematic side view with a gear plate.

As shown in FIG. 7, many bores are provided on the gear plate 48, and through them the folding rollers 52*a*–52*j* can be driven via gear wheels meshing with one another. Since each of the folding rollers 52*a*–52*j* is connected to the gear plate 48 via a coupling, such as an Oldham coupling (cross-staff head coupling), it is possible by way of the couplings to compensate for the variable axial setting spacings between the folding rollers and the knife shafts. In terms of the drive, the knife shaft pair 54 is coupled to the same drive 56 as the folding rollers 52*a*–52*j*, which are typically joined via a train of gear wheels. According to the invention, the gear plate 48 is now embodied such that the knife shafts 16 and 18, provided in modular and/or pivotable fashion in the side walls, and the pivotably disposed delivery roller 26 are disposed outside the gear plate 48. The drive for the shafts and rollers located outside the gear plate can be accomplished with a belt, chain or toothed belt drive, which directly drives a coupling element 60, in particular a coupling gear wheel, for instance in the direction of the path indicated. The coupling gear wheel 60 is operatively connected directly to a driving gear wheel for the knife shaft 18, which in turn can drive the other gear wheels of the rollers and shafts of the module. This assures that the knife shafts 54, 16 and 18 are driven synchronously with one another. This construction also makes it possible for the advantages of using a gear plate to be employed in the modular type of construction according to the invention as well. The synchronized or mutually adapted drive of the rollers in the fundamental part of the folder unit and the rollers in the modular or pivoting part of the folder unit can, however, also be attained by providing each part with its own drive, and the drives can be coupled to one another or adapted to one another via a control unit 62, which is only schematically indicated. For example, the pair of knife shafts 54 and the folding rollers 52*a*–52*j* can be driven by their own drive, while the knife shafts 16, 18 and the pivotable delivery roller 26 are driven together or each separately by its own drive, which is then preferably embodied as a controllable servomotor. Adapting the entire drive can be done via a separate drive controller (see control unit 62) that can also be integrated with the entire machine control.

The folder unit of the invention can be provided in a folding machine in one or more combinations of the possible embodiments shown in the examples of FIGS. 1–7, so that the variability of the folding machine is increased considerably, and accessibility to the knife shafts or downstream-supported pairs of knife shafts is made considerably easier. The settability of the pair of knife shafts is thus simplified considerably as well.

The individual rollers are typically driven via gear wheels, and the ends of the rollers themselves can be embodied as gear wheels which either mesh with one another or are connected via intermediate gear wheels. The coupling and decoupling of the drives of the rollers is thus typically done by lifting the gear wheel out of the engagement.

We claim:

1. A folder unit for processing flat products running in a product travel direction, comprising:

side walls each having a front side pointing downstream with respect to the product travel direction;

a framework;

a processing device supported by said framework;

a plurality of rollers rotatably supported by said side walls;

each of said side walls having, at said front side, a recess forming an opening pointing downstream with respect to the product travel direction, said recesses being disposed opposite one another and configured to receive said framework.

2. The folder unit according to claim 1, wherein said recesses have a substantially identical shape.

3. The folder unit according to claim 1, wherein said processing device includes a roller.

4. The folder unit according to claim 3, wherein said roller of said processing device is a delivery roller.

5. The folder unit according to claim 3, wherein said roller of said processing device is a knife shaft.

6. The folder unit according to claim 5, wherein said processing device further includes a delivery roller disposed, with respect to the product travel direction, downstream of said knife shaft.

7. The folder unit according to claim 1, wherein said framework is pivotably mounted in said recesses and is pivotable out of said recesses in a direction pointing downstream with respect to the product travel direction.

8. The folder unit according to claim 7, further including a locking device for locking said framework in a plurality of pivoting positions.

9. The folder unit according to claim 5, including:

a further framework adjoined to said framework and disposed, with respect to the product travel direction, downstream of said framework; and a further processing device supported by said further framework.

10. The folder unit according to claim 9, wherein said further framework is pivotably mounted to said framework.

11. The folder unit according to claim 4, wherein said processing device includes a cross-member pivotably mounted to said framework above said delivery roller, and configured for receiving additional elements.

12. The folder unit according to claim 11, wherein said additional elements are selected from the group consisting of a stripper and a light scanner.

13. The folder unit according to claim 7, wherein said framework, in a non-pivoted position thereof, is rigidly connected to said side walls.

14. The folder unit according to claim 7, which further comprises a coupling device for rigidly connecting said framework to at least one of said side walls in a non-pivoted position of said framework.

15. The folder unit according to claim 1, including:

a drive;

a gear plate operatively connected to said drive and adapted for driving said plurality of rollers;

said rollers including at least two folder rollers; and said framework and said gear plate being disposed apart from each other.

16. The folder unit according to claim 15, wherein said processing device is coupled to said drive.

17. The folder unit according to claim 16, wherein said processing device is mechanically coupled to said drive.

18. The folder unit according to claim 17, wherein said processing device is coupled to said drive via one of a belt drive, a pulley drive, and a chain drive.

19. The folder unit according to claim 16, which comprises a control device coupling said drive and said processing device.

20. The folder unit according to claim 1, including:

a first gear-wheel operatively connected to said processing device; and at least one second gear-wheel operatively connected to said plurality of rollers;

said first gear-wheel and said second gear-wheel mutually meshing in operation.

21. The folder unit according to claim 1, wherein said rollers are selected from the group consisting of folding rollers and knife shafts.

22. A folding machine for folding products in a product processing machine, comprising at least one folder unit according to claim 1.

23. The folder unit according to claim 9, wherein:

said framework includes two framework walls each having a wall front side pointing downstream with respect to the product travel direction;

each of said framework walls having, at said wall front side, a wall recess forming a wall opening pointing downstream with respect to the product travel direction; and said wall recesses being disposed opposite one another and configured to receive therein said further framework rigidly connected to said framework.

* * * * *